US005179923A

United States Patent [19]

Tsurutani et al.

[11] Patent Number: 5,179,923

[45] Date of Patent: Jan. 19, 1993

[54] FUEL SUPPLY CONTROL METHOD AND ULTRASONIC ATOMIZER

[75] Inventors: Kazushi Tsurutani; Daijiro Hosogai; Kakuro Kokubo; Taiji Kobayashi; Noboru Higashimoto; Masami Endoh; Kazuyoshi Namiyama; Makoto Yoneda, all of Ooi, Japan

[73] Assignee: Tonen Corporation, Tokyo, Japan

[21] Appl. No.: 545,787

[22] Filed: Jun. 29, 1990

[30] Foreign Application Priority Data

Jun. 30, 1989 [JP] Japan ..... 1-168633
Jun. 30, 1989 [JP] Japan ..... 1-168634
Jun. 30, 1989 [JP] Japan ..... 1-168635

[51] Int. Cl.[5] ..... F02D 41/06

[52] U.S. Cl. ..... 123/435; 123/491; 123/590; 123/179.18

[58] Field of Search ..... 123/179 G, 179 L, 491, 123/590, 435

[56] References Cited

U.S. PATENT DOCUMENTS

| | | | |
|---|---|---|---|
| 2,791,994 | 5/1957 | Grieb | 123/590 |
| 3,677,236 | 7/1972 | Moss | 123/491 |
| 3,680,532 | 8/1972 | Omori | 123/179 G |
| 3,847,130 | 11/1974 | Miyoshi et al. | 123/491 |
| 4,231,333 | 11/1980 | Thatcher et al. | 123/179 G |
| 4,389,995 | 6/1983 | Koide et al. | 123/491 |
| 4,576,136 | 3/1986 | Yamauchi et al. | 123/590 |

*Primary Examiner*—Andrew M. Dolinar

*Attorney, Agent, or Firm*—Nikaido, Marmelstein, Murray & Oram

[57] ABSTRACT

Fuel supply in an ultrasonic atomizer is conducted according to a fuel increment ratio pattern in which the increment of fuel in fuel increment control for starting and warming up is 70% or less of that in a typical conventional pressure injection valve system, thereby improving startability, accelerability and fuel consumption rate and further enabling a reduction in exhaust emissions. When the engine is started in low-temperature conditions, the fuel is supplied by continuous injection to make uniform and reduce the mean diameter of droplets of atomized fuel, thereby improving the ignitability and startability. The fuel injection start timing is varied in accordance with the combustion chamber temperature at the time of starting the engine, i.e., when the engine is to be started in low-temperature conditions, no fuel is injected until a predetermined time has elapsed, and the fuel injection is started after the combustion chamber temperature has been raised by means of compression heat by driving the starter, thereby improving the cold startability even in the case of a fuel with a relatively high flash point. When the engine is in a transient operating condition, fuel injection from the ultrasonic atomizer is executed immediately before the velocity of an air stream in the vicinity of the ultrasonic atomizer rises, whereby the fuel that is atomized with a sufficient spread in the intake pipe can be carried in this state by the air stream to the combustion chamber where it is burned.

3 Claims, 16 Drawing Sheets

FIG. 1
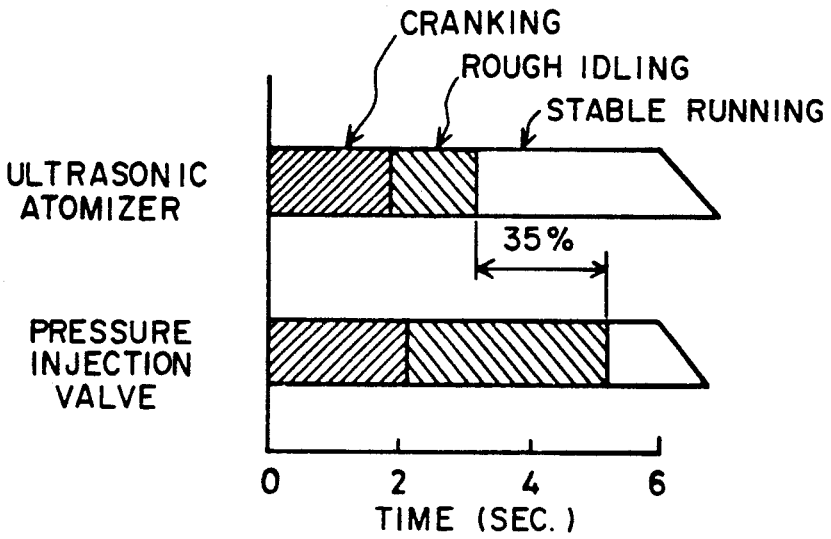
FIG. 2(a)
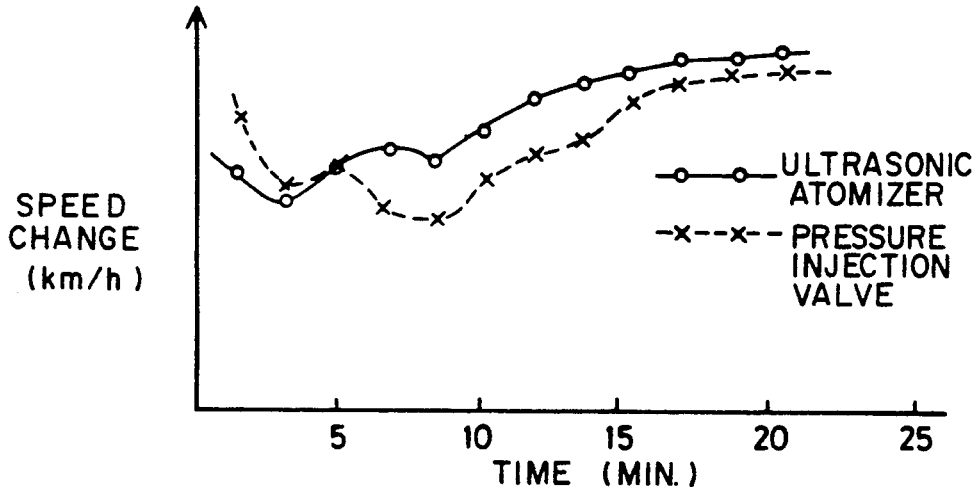
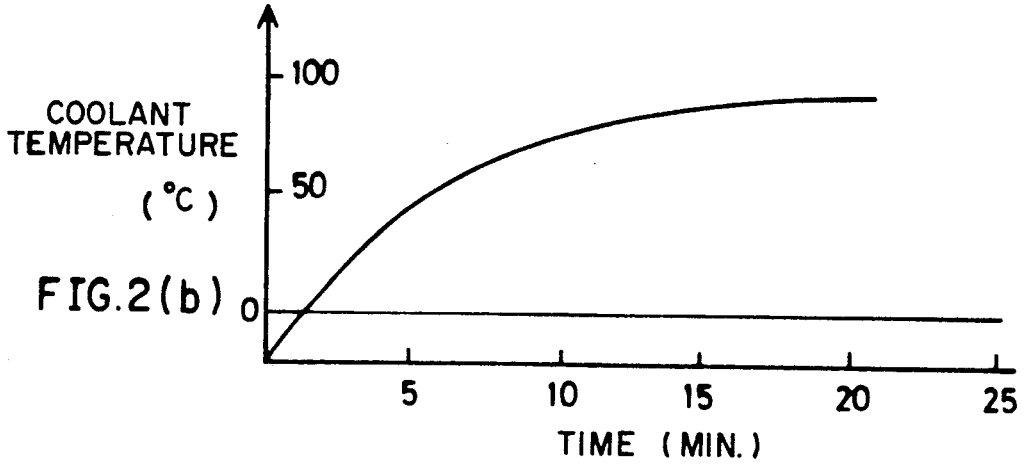
FIG.2(b)

FIG. 8
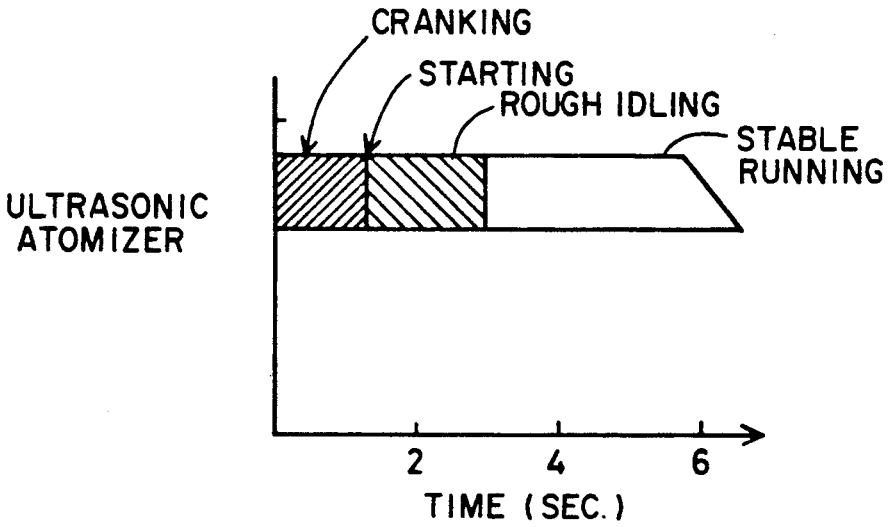
FIG. 9 (a)
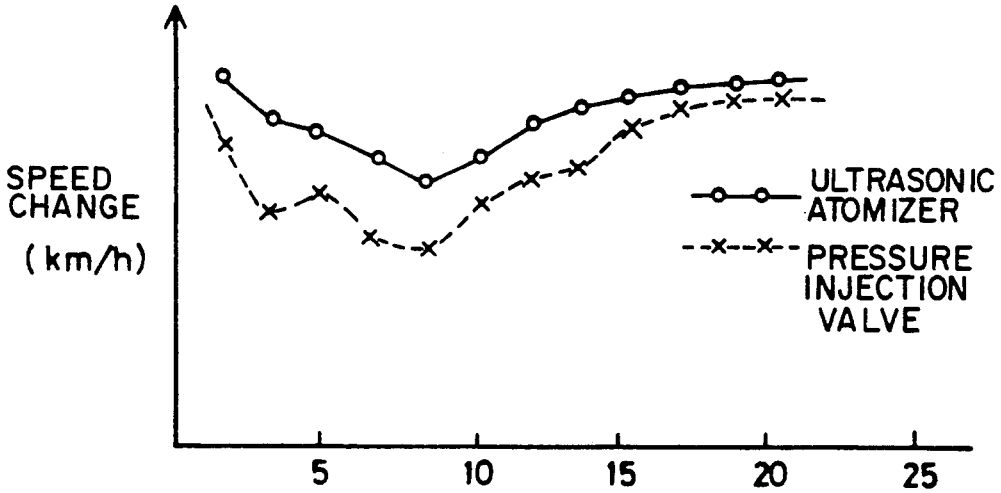
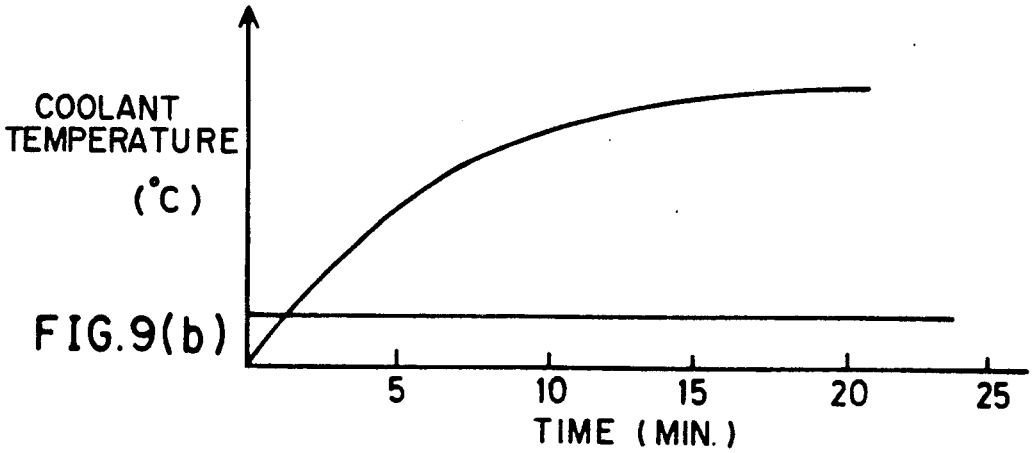
FIG.9(b)

FUEL SUPPLY CONTROL METHOD AND ULTRASONIC ATOMIZER

FIELD OF THE INVENTION

The present invention relates to a fuel supply control method for spark ignition engines which are used, for example, as automotive engines, outboard motors, portable power units, and drive units for household heat pumps. The present invention also relates to an ultrasonic atomizer for alcohol engines which is effectively employed to carry out the fuel supply control method.

BACKGROUND OF THE INVENTION

Spark ignition engines for automobiles, for example, have heretofore employed a carburetor system in which fuel is sucked in and atomized to mix with air in a carburetor by means of a negative air pressure that is produced by the flow of intake air, or a pressure injection valve system in which a liquid fuel is injected from a nozzle under pressure and the fuel thus atomized is mixed with air. The fuel-air mixture produced in either way is then carried to a combustion chamber by a stream of air flowing at a high velocity, where it is burned by spark ignition. The above-described fuel-air mixture is in a state where droplets of fuel are suspended in mist-like form in a high-velocity air stream. Although part of the fuel is in the form of vapor, the greater part of it adheres to the wall of the flow path and forms into a liquid, which is sucked into a cylinder through an intake pipe by the pressure of the air stream. During this process, the fuel in the liquid form is evaporated by the heat from the wall surface of the flow path or the heat in the cylinder. Thus, since the greater part of the fuel evaporates while being delivered in the form of a liquid flow on the wall surface, the injected fuel cannot promptly be delivered into the cylinder, so that the engine response and the combustion efficiency are not always satisfactory. In particular, at the time of starting the engine, the wall surface of the intake pipe is dry and consequently the greater part of the fuel injected adheres to the wall surface and fails to reach the combustion chamber. Thus, the above-described conventional systems suffer from inferior startability.

To cope with this problem, electronically controlled injection engines have heretofore adopted a control method wherein a pressure injection valve is controlled with a computer such that the supply of fuel is incremented according to a predetermined increment ratio pattern (in which the supply of fuel in steady-state running is determined to be 1), thereby striving to improve the startability. More specifically, the increment ratio is maintained at a constant level while the starter is in an operative state, and after the starter has been turned off, the increment ratio is reduced at a given rate in accordance with the temperature of a coolant. In carburetor engines, the increment control of the supply of fuel is effected by a choke mechanism to improve the startability. In this system, however, an oversupply of fuel occurs during and immediately after the starting of the engine, resulting in a rise in the fuel consumption rate and an increase in exhaust emissions (HC, CO, etc.).

In low-temperature (cold) conditions, fuel increment control for warming up is carried out according to a pattern in which the increment ratio is increased in accordance with the lowering in the coolant temperature to compensate for the deterioration of the operating characteristics due to lowering in the vaporability of gasoline in the intake pipe. In this case also, an oversupply of fuel causes similar problems to those in the fuel increment control at the time of starting the engine.

FIG. 1 shows the results of an experiment in which the above-described fuel increment control for starting was carried out with the same increment ratio pattern for an engine equipped with a conventional pressure injection valve and an engine equipped with an ultrasonic atomizer (described later).

As will be clear from the figure, in the engine equipped with the ultrasonic atomizer the time required to reach steady-state running shortens by about 35% of that in the engine equipped with the pressure injection valve mainly because of the reduction in the idling time, but there is substantially no reduction in the cranking time (i.e., the period of time during which the starter is ON).

Similarly, an engine equipped with a conventional pressure injection valve and an engine equipped with an ultrasonic atomizer (described later) were subjected to the fuel increment control for warming up at an ambient temperature of −20° C., with the throttle valve full open and with the gear shifted at an optimal timing to examine accelerability based on the speed change. The results are shown in FIGS. 2(*a*)–2(*b*), in which the solid line shows the results for the ultrasonic atomizer, and the chain line shows those for the pressure injection valve.

During the first five minutes, in which the coolant temperature has not yet reached 50° C., the engine equipped with the conventional pressure injection valve is better in accelerability, and at about 60° to 70° C., the accelerability becomes substantially constant.

Thus, no adequate operating characteristics can be obtained if the engine equipped with the ultrasonic atomizer is subjected to fuel increment control for starting and warming up with the same patterns as those for the engine equipped with the conventional pressure injection valve.

On the other hand, in the ultrasonic atomizer the fuel is substantially completely atomized when injected and is mixed with air to form a fuel-air mixture and efficiently delivered into the cylinder by an air stream in this state, so that the combustion efficiency is high. In addition, if the fuel injection is carried out in a pulsational manner and the injection frequency or duty is properly varied, the response of the engine can be improved.

Incidentally, with the recent strict regulation of exhaust emissions (HC, CO, etc.), attempts have been made to utilize alcohols such as methanol and ethanol as fuel, and spark ignition engines have been proposed which use, for example, a fuel consisting of 100% of methanol or ethanol, or an alcohol-gasoline mixture which contains not less than 50% of alcohol. Methanol and ethanol are superior from the environmental point of view, but the flash points of these fuels are high in comparison to gasoline, i.e., 11° C. and 13° C., and the latent heat of vaporization of these fuels is relatively large. Therefore, if the engine is left to stand for a long time and the temperature in the combustion chamber becomes lower than the flash point of these fuels, the engine cannot be started. Thus, this type of engine has the disadvantage of inferior startability. To overcome this problem, Japanese Patent Laid-Open (KOKAI) No. 57-153964 (1982) proposes a method wherein an intake pipe of an engine is provided with an ultrasonic vibration type spray nozzle and a surface heating element which reflects the spray from the nozzle to form a mist of fine droplets, and at the time of starting the engine, an alcohol fuel is atomized by the spray nozzle and the surface heating element, and after the engine has been started, the alcohol fuel is supplied through a carburetor. In this method, however, the ultrasonic spray nozzle and the surface heating element must be provided merely for the starting of the engine, which is not very frequently performed, and the cost increases correspondingly.

Conventional ultrasonic atomizers will next be explained with reference to FIGS. 3 and 4.

FIG. 3 shows a multihole ultrasonic injection valve of the type that a liquid is supplied to an atomization surface from a plurality of nozzle holes. The ultrasonic injection valve comprises a cylinder 101, a nozzle body 102, a vibrator horn 103 and an electroacoustic transducer 104. The cylinder 101 is formed with a fuel feed passage 105, and the nozzle body 102 is provided with a plurality of nozzle holes 106 which are communicated with the fuel feed passage 105, the nozzle holes 106 being circumferentially formed in the nozzle body 102 so that fuel which is injected from the nozzle holes 106 is supplied to the vibrator horn 103 where it is atomized.

FIG. 4 shows an annular ultrasonic injection valve of the type that a liquid is supplied to an atomization surface from a ring-shaped groove. This ultrasonic injection valve comprises an outer cylinder 111, an inner cylinder 112, a vibrator horn 113 and an electroacoustic transducer 114. A fuel feed passage 115 is formed in between the outer cylinder 111 and the inner cylinder 112, so that fuel is supplied to the vibrator horn 113 from the entire circumference of the outer cylinder 111 and thus atomized on the horn surface.

Incidentally, it is essential in alcohol engines to form a thin film of liquid uniformly over the atomization surface of the vibrator in order to ensure an excellent atomization efficiency over a wide fuel supply range. It is also important, in order to atomize the whole amount of fuel supplied, to prevent the fuel from being splashed on the atomization surface even when the fuel feed velocity is high.

However, in the multihole ultrasonic injection valve stated above, the quantity of atomized fuel is determined by the quantity of fuel supplied from the nozzle holes 106 and it is therefore impossible to obtain a high turn-down ratio that represents the ratio of the maximum atomization quantity to the minimum atomization quantity. When the injection valve is used in a horizontal position, it is difficult to distribute the liquid uniformly among the nozzle holes 106 and the resulting spray becomes nonuniform. If the number of nozzle holes 106 is increased, the fuel may be distributed uniformly. However, the number of nozzle holes 106 which can be provided is limited, and since it is difficult to form a large number of nozzle holes 106 by machining process, the production cost increases.

In the annular ultrasonic injection valve, the atomization quantity is determined by the clearance 116 between the tip of the outer cylinder 111 and the vibrator horn 113. Accordingly, a high degree of accuracy is required to mount the outer cylinder 111 to the collar portion 113*a* of the vibrator horn 113, which leads to an increase in the production cost. If the clearance 116 cannot be provided with adequate tolerances, a high turn-down ratio cannot be obtained, and the resulting spray becomes nonuniform. In addition, the above-described prior art involves the problem that the spray angle of the fuel atomized by the ultrasonic injection valve is relatively large and the fuel is likely to adhere to the inner wall of the intake pipe, which has a relatively small diameter.

Thus, in the ultrasonic atomizer, the film of a liquid fuel injected flows along the horn surface and scatters in the form of liquid droplets from the horn tip. The size of liquid droplets formed at that time is related to the thickness of the liquid film flowing along the horn surface, that is, the thicker the liquid film, the larger the droplet diameter, and vice versa. Accordingly, when the fuel injection is carried out in a pulsational manner, the thickness of the liquid film varies periodically and the droplet diameter periodically increases and decreases in response to the change in the film thickness. When the droplet diameter is large, the droplets are likely to adhere to the wall surface of the intake pipe and hence cannot effectively mix with air. Therefore, the engine cannot readily be ignited, and the startability deteriorates, particularly in low-temperature conditions. The deterioration of the startability is particularly noticeable in automotive engines of the SPI (Single Point Injector) type in which fuel feed is performed in the vicinity of a carburetor to distribute the fuel to a plurality of cylinders.

In addition, when an alcohol fuel is used, the cold startability is not good even if an ultrasonic atomizer is employed, as stated above.

Unlike the conventional system wherein fuel is sucked in by means of an intake air stream, the fuel injection system that employs an ultrasonic atomizer is capable of conducting fuel injection independently of the air stream. Therefore, no satisfactory explanation has yet been given about a condition of air stream which is suitable for efficient injection of fuel.

SUMMARY OF THE INVENTION

The present invention aims at solving the above-described problems of the prior art.

It is an object of the present invention to provide a fuel supply control method for an engine equipped with an ultrasonic atomizer, wherein a fuel supply pattern is controlled.

It is another object of the present invention to provide a fuel increment pattern control method which is capable of effectively carrying out the fuel increment control for both starting and warming up.

It is still another object of the present invention to provide a fuel supply control method for engines which is capable of improving the startability in low-temperature conditions.

It is a further object of the present invention to enable a maximal output to be obtained by controlling the timing at which fuel injection is performed by an ultrasonic atomizer.

It is a still further object of the present invention to improve the startability of alcohol engines simply by adopting an ultrasonic atomizer, without employing a carburetor.

It is a still further object of the present invention to provide an ultrasonic injection valve which is designed so that it is possible to set an optimal spray angle irrespective of the quantity of fuel supplied, increase the turn-down ratio, and obtain a spray which is uniform over the entire circumference.

To these ends, the present invention provides a method of driving an engine wherein a fuel is atomized by an ultrasonic atomizer and carried by a stream of air to a combustion chamber where it is ignited by a spark, which comprises controlling a fuel supply pattern at least at the time of starting the engine.

The arrangement may be such that the fuel supply is conducted according to a fuel increment ratio pattern in which the increment than fuel in fuel increment control for starting and warming up is 70% or less of that in a typical conventional pressure injection valve system.

The arrangement may also be such that the fuel is continuously injected when the engine is started in low-temperature conditions, and when the continuous fuel injection is performed, the fuel feed pressure is lowered.

The arrangement may also be such that the fuel injection start timing is varied according to whether the combustion chamber temperature is higher or lower than a predetermined temperature, i.e., when the combustion chamber temperature is lower than a predetermined temperature, a starter switch is turned on with a throttle valve closed, and fuel injection is started after a predetermined time has elapsed, and when the combustion chamber temperature is particularly low, the throttle valve is opened when an ignition switch is turned on, and after a predetermined time has elapsed, the throttle valve is closed, and at the same time, fuel injection is started.

The arrangement may also be such that fuel injection from the ultrasonic atomizer is executed immediately before the velocity of an air stream in the vicinity of the ultrasonic atomizer rises.

In addition, the present invention provides an ultrasonic atomizer for an alcohol engine, comprising: a vibrator horn which is disposed inside an intake pipe to atomize an alcohol fuel, the vibrator horn having at the distal end a slant portion and a reduced-diameter portion; and a sleeve which is disposed around the outer periphery of the vibrator horn to feed the fuel over the entire circumference of the vibrator horn, the sleeve having an opening which faces the slant portion.

BRIEF DESCRIPTION OF THE DRAWINGS

FIG. 1 shows engine operating characteristics obtained by conventional fuel increment control for starting;

FIGS. 2(*a*)–2(*b*) show engine operating characteristics obtained by conventional fuel increment control for warming up;

FIG. 8 shows engine operating characteristics obtained by fuel increment control for starting;

FIGS. 9(*a*)–9(*b*) show accelerability obtained by fuel increment control for warming up;

DESCRIPTION OF THE PREFERRED EMBODIMENTS

Embodiments of the present invention will be described below.

Figure 3:
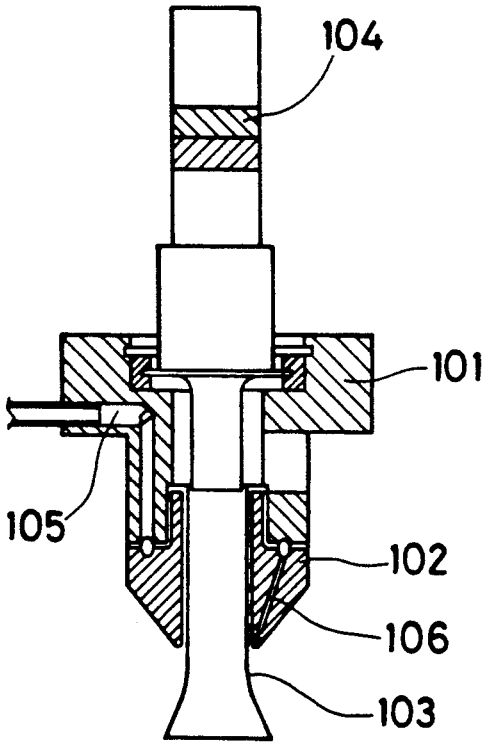
FIG. 3 PRIOR ART
FIGS. 3 and 4 are sectional views of two different types of conventional ultrasonic injection valves.
Figure 4:
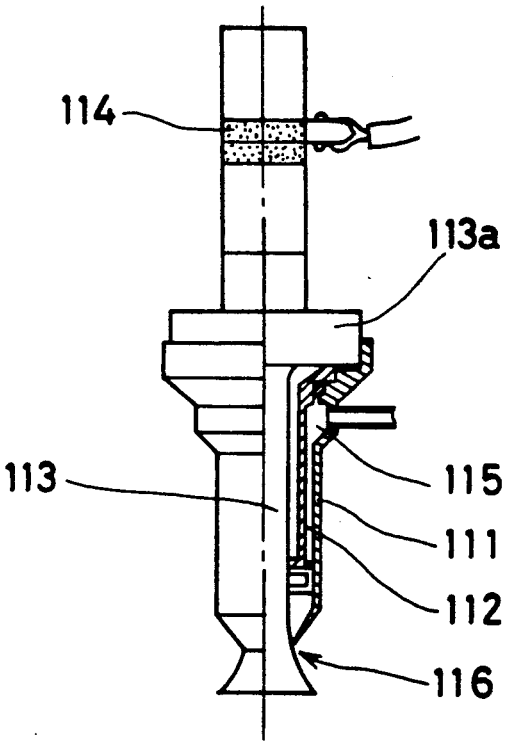
FIG. 4 PRIOR ART
Figure 5:
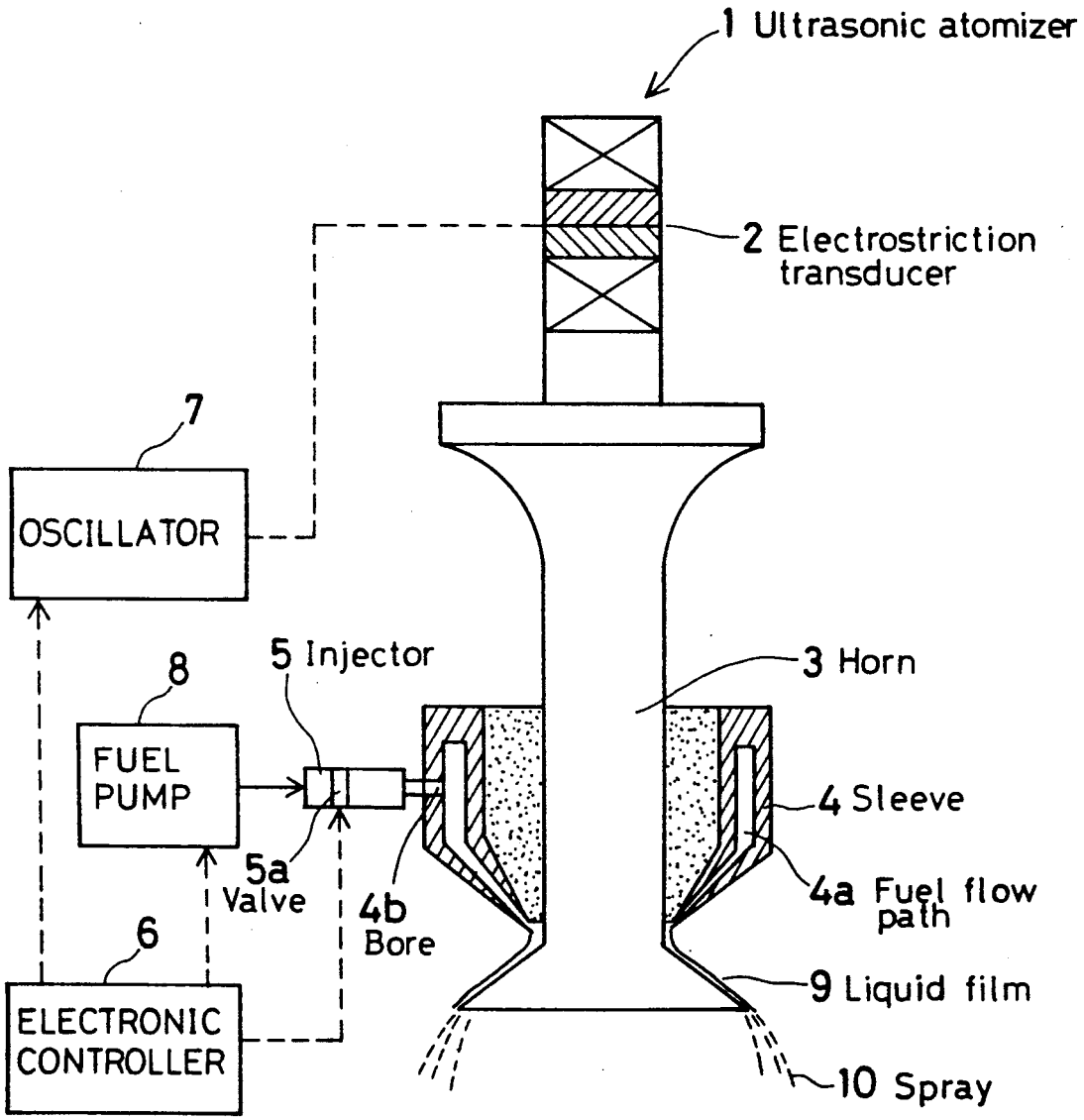
FIG. 5 shows the arrangement of an ultrasonic atomizer according to the present invention.

FIG. 5 shows the arrangement of an ultrasonic atomizer according to the present invention.

As will be clear from FIG. 5, the ultrasonic atomizer 1 comprises an electrostriction transducer 2, a horn 3 and a sleeve 4. The electrostriction transducer 2 is driven with an AC voltage by an oscillator 7, which is controlled by an electronic controller 6, so that the transducer 2 vibrates in an ultrasonic frequency region. The vibration of the transducer 2 is transmitted to both the horn 3 and the sleeve 4. Meantime, a liquid fuel from a fuel pump 8 is intermittently supplied from an injector 5 in which a valve 5*a* is opened and closed under the control of the electronic controller 6. The fuel supplied is then injected onto the surface of the horn 3 through a fuel flow path 4*a* which is formed in the sleeve 4. The injected fuel forms a liquid film 9 and flows downward on the surface of the horn 3 and is then sprayed in the form of droplets from the horn tip by the ultrasonic vibration of the horn 3.

One embodiment of the fuel supply control method of the present invention, in which fuel increment control for both starting and warming up is carried out, will next be explained with reference to FIGS. 6 to 10.

Figure 6:
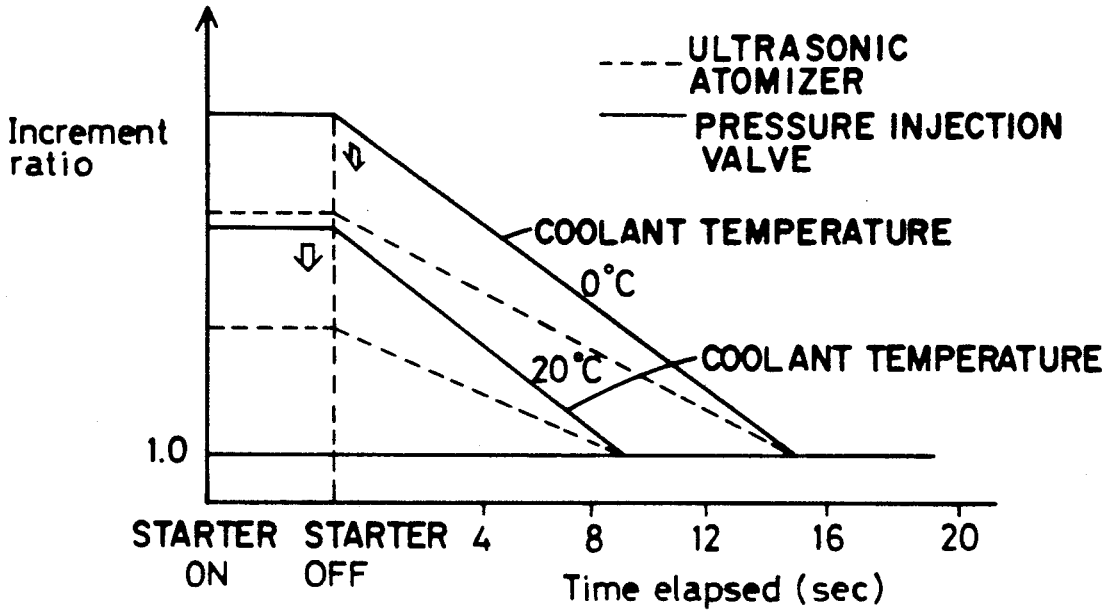
FIG. 6 shows fuel increment patterns for starting.
Figure 7:
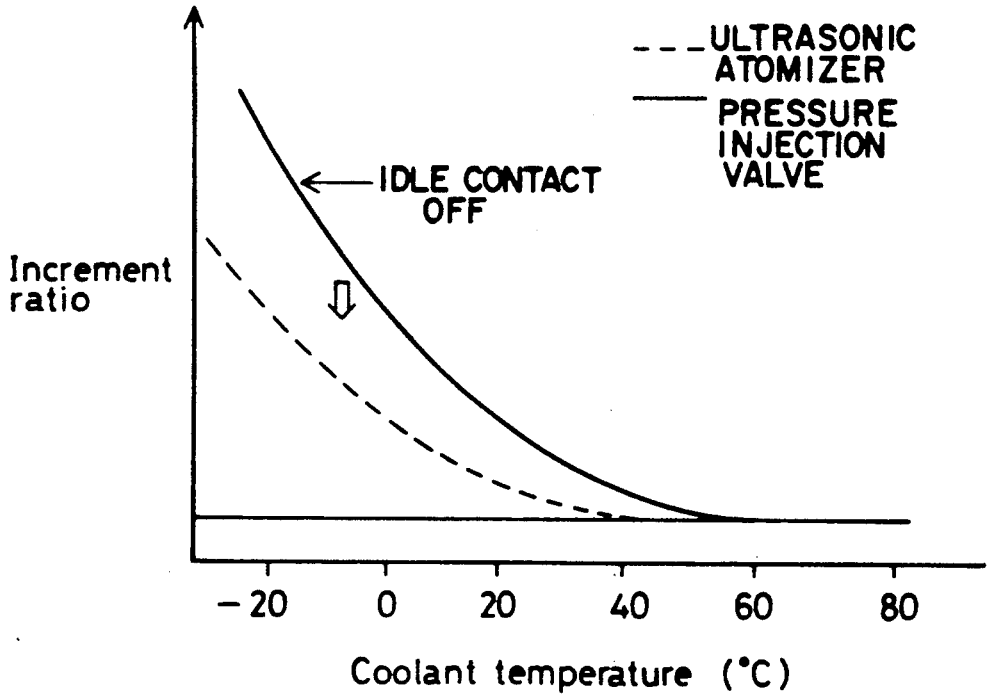
FIG. 7 shows fuel increment patterns for warming up.

In this embodiment, the fuel supply is controlled according to a fuel increment ratio pattern in which the increment of fuel in the fuel increment control for both starting and warming up is 70% or less than that in a typical conventional pressure injection valve, as shown by the chain lines in FIGS. 6 and 7. Assuming that the current increment ratio is 2.0, for example, the increment ratio in this embodiment is $(2.0-1.0)\times 0.7+1.0=1.7$. In this way, the fuel increment pattern is controlled.

FIGS. 8 and 9(*a*)–9(*b*) show startability and accelerability which are obtained when the increment of the fuel supply in the ultrasonic atomizer system is set at 50% of that in the conventional pressure injection valve system.

As will be understood from FIG. 8, the cranking time at the time of starting the engine is markedly reduced in comparison to the results shown in FIG. 1.

As will be clear from FIGS. 9(*a*)–9(*b*), the ultrasonic atomizer system excels by a large margin the pressure injection valve system in the accelerability during the first five minutes.

In addition, the reduction in the excess fuel enables achievement of an improvement in the fuel consumption rate and a marked reduction of HC and CO emissions.

These advantageous characteristics can be satisfactorily attained by setting the increment of the fuel supply in the ultrasonic atomizer system at 70% or less that in the pressure injection valve system.

Figure 10:
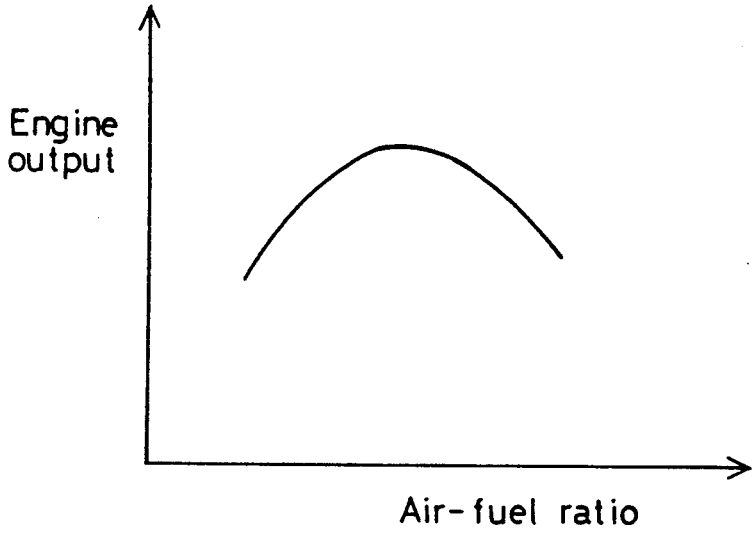
FIG. 10 shows a characteristic curve representing the relationship between the air-fuel ratio and the engine output.

The air-fuel ratio and the engine output are related to each other, as shown in FIG. 10. As will be clear from the figure, if the air-fuel ratio is out of a predetermined range, the engine output is lowered. In the case of the ultrasonic atomizer system, the air-fuel ratio is set on the assumption that the atomized fuel is delivered to and burned in the combustion chamber with substantially no droplets adhering to the wall surface of the intake pipe. However, as a result of the fuel increment control for starting and warming up, part of the fuel adheres to the wall surface, which results in a change in the air-fuel ratio. This is considered to be one of the causes of lowering in the engine output.

Accordingly, if fuel increment patterns such as those shown by the chain lines in FIGS. 6 and 7 are formed into a map to obtain a control table and, at the time of starting the engine or in low-temperature conditions, the fuel increment pattern is controlled with reference to the control table, it is possible to better the engine operating characteristics during the fuel increment control.

Figure 11:
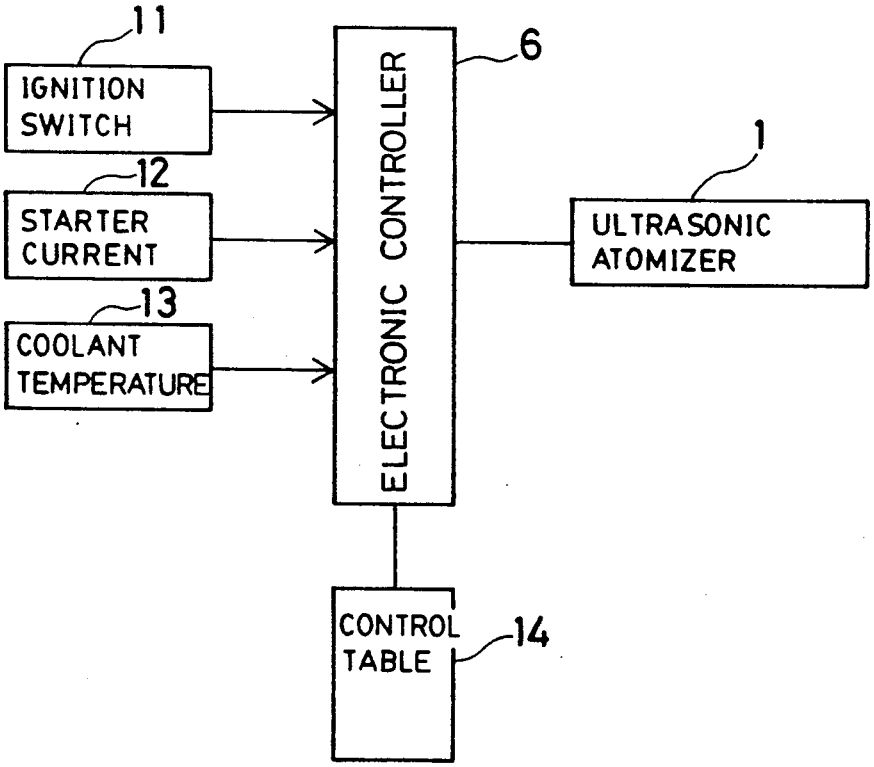
FIG. 11 is a block diagram showing the arrangement of a system for carrying out the fuel supply control method according to the present invention.

FIG. 11 is a block diagram showing the arrangement of a system for carrying out the above-described fuel supply control.

An electronic controller 6 reads data, for example, an ignition switch signal, starter current, coolant temperature, etc., and drives the ultrasonic atomizer 1 with reference to a control table 14 formed from data concerning increment ratios at the time of starting the engine or in low-temperature conditions, thereby enabling efficient drive of the engine.

It should be noted that the present invention is applicable to both the SPI (Single Point Injector) system in which fuel injection is performed in the vicinity of a carburetor to distribute the fuel to the cylinders and the MPI (Multi Point Injector) system in which fuel injection is performed in the vicinity of the intake valve of each cylinder.

According to this embodiment, the increment of the fuel supply by the increment control for starting and warming up is set at 70% or less than that in the conventional injection system, thereby making full use of the advantageous features of the ultrasonic atomizer to improve both startability and accelerability and also improve the fuel consumption rate and reduce exhaust emissions by a large margin.

Figure 12:
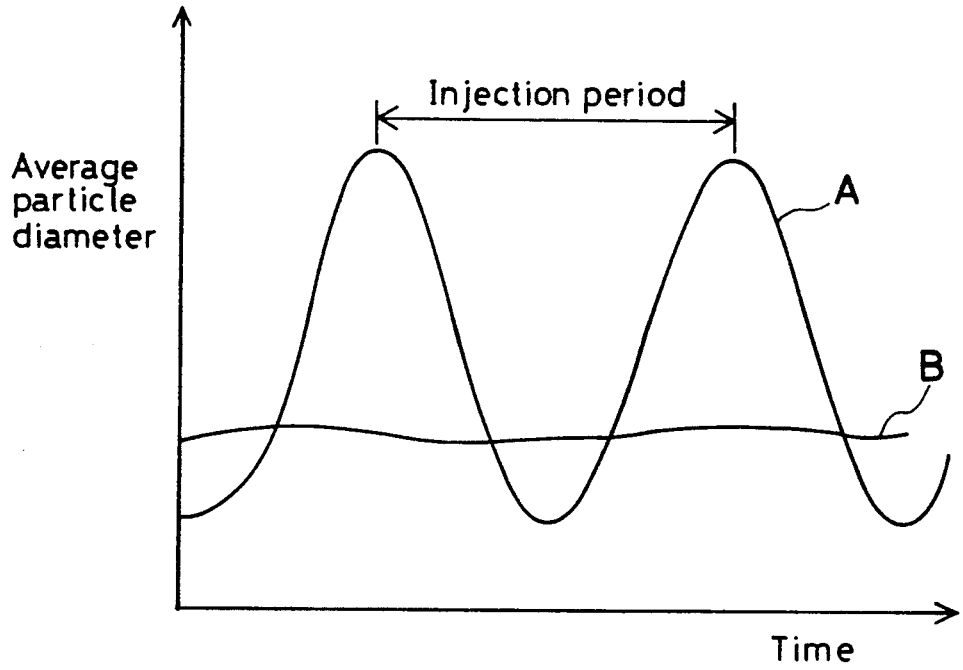
FIG. 12 shows changes in the mean diameter of fuel sprayed.

Another embodiment of the present invention, which is designed so that the droplet diameter is made uniform and also reduced to improve the startability, will next be explained with reference to FIG. 12.

Incidentally, the liquid film 9 is relatively thick immediately after the injection of the fuel and becomes thinner thereafter. Accordingly, the mean diameter of droplets of the fuel sprayed from the tip of the horn 3 varies with the injection period, as shown by the curve A in FIG. 12. In this embodiment, therefore, when the fuel-air mixture cannot readily be ignited, particularly at the time of starting in low-temperature conditions, the fuel injection is continuously performed under the control of the electronic controller 6. By this continuous injection, the thickness of the liquid film flowing on the surface of the horn 3 is maintained at a substantially constant level, so that the means diameter becomes uniform, as shown by the curve B in FIG. 12, and also becomes smaller than the average of the mean diameters in the case of the intermittent injection (curve A). As a result, the fuel is effectively mixed with air, so that the fuel-air mixture becomes relatively easy to ignite and thus the startability improves. However, since the fuel supply increases because of the continuous injection, the feed pressure of the fuel from the fuel pump 8 is lowered so that the fuel feed rate is kept constant under the control of the electronic controller 6. After the engine has been started, the continuous injection is switched over to the intermittent injection so that it is possible to cope with the required transient response.

When the ambient temperature is relatively high and the engine can therefore be readily started, no continuous injection is needed, as a matter of course. Whether to perform continuous injection or not at the time of starting the engine may be determined as follows: For example, the temperature of coolant is detected and read in the electronic controller 6, and if the detected coolant temperature is lower than a predetermined level, continuous injection is effected, whereas, if the detected temperature is not lower than the predetermined level, intermittent injection is carried out. The predetermined temperature level may be properly set in accordance with the fuel used.

According to this embodiment, the diameters of droplets of fuel sprayed from the ultrasonic atomizer can be made uniform and reduced by continuously injecting the fuel at the time of starting the engine in low-temperature conditions, so that the startability can be improved.

Another embodiment wherein the fuel injection start timing is varied in accordance with the combustion chamber temperature at the time of starting the engine to improve the startability, particularly in low-temperature conditions, will next be explained with reference to FIGS. 13 to 16.

In this embodiment, the fuel injection start timing is varied according to whether the combustion chamber temperature is relatively high or low at the time of starting the engine, and when the combustion chamber temperature is relatively low, the fuel injection is started a predetermined time after the starter switch has been turned on.

Figure 13:
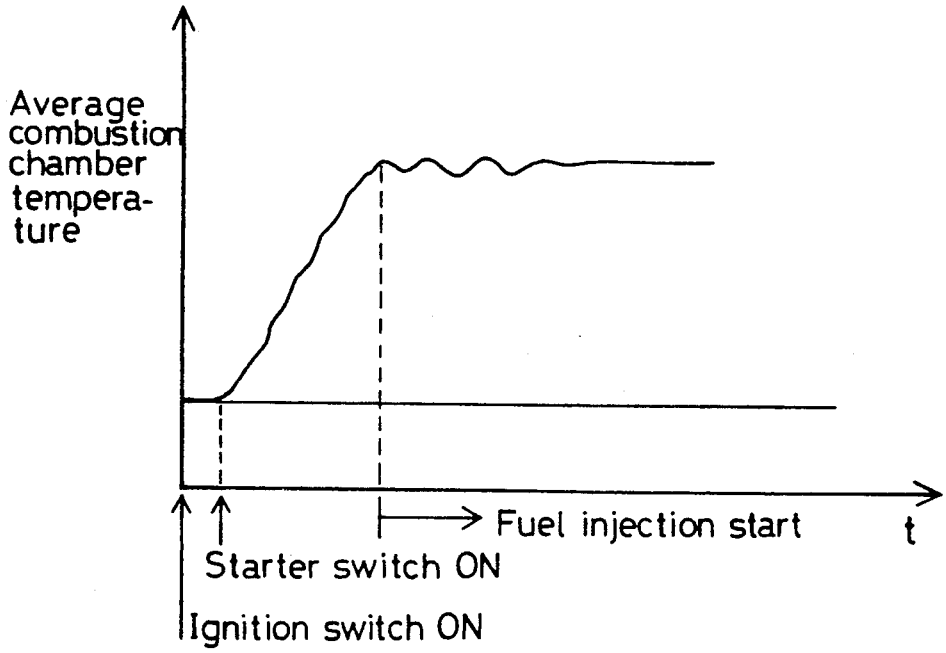
FIG. 13 shows a method of controlling the timing at which fuel injection is started at the time of starting the engine.
Figure 14:
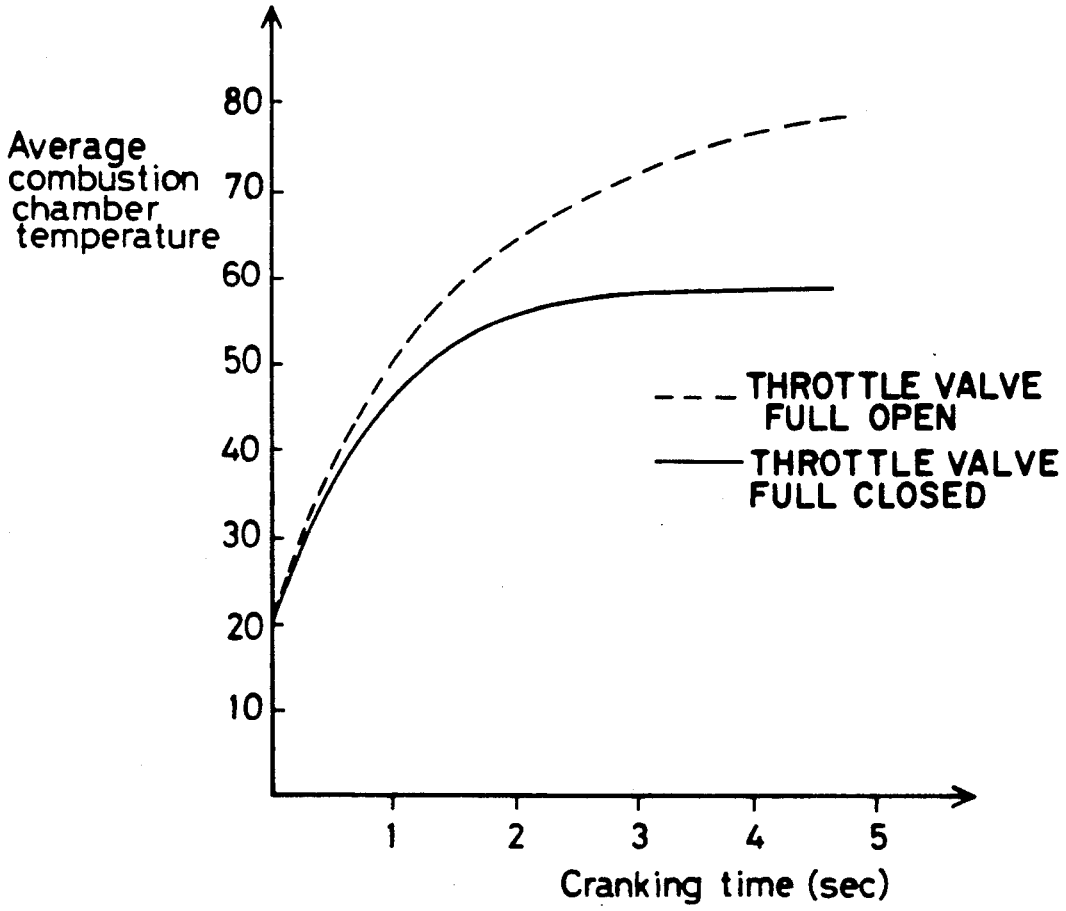
FIG. 14 shows curves representing the rise in temperature caused by compression heating when the throttle valve is fully opened and when it is closed.

As the starter switch is turned on to drive the engine by a starting motor, the combustion chamber is repeatedly subjected to heating by compression heat and cooling by adiabatic expansion, and the temperature in the combustion chamber is raised by the compression heat that is transmitted through the cylinder wall. The atmosphere temperature in the combustion chamber, which is detected by a thermocouple, rises while varying zigzag in response to the compression and expansion, as shown in FIG. 13. The way in which the temperature rises depends on the level of compression pressure. For example, as shown in FIG. 14, when the throttle valve is full open, the combustion chamber temperature rises along the chain-line curve, whereas, when the throttle valve is closed, the temperature rises along the solid-line curve.

Accordingly, in this embodiment, when the combustion chamber temperature is relatively high and the engine can therefore be readily started, the fuel injection is started at the same time as the starter switch is turned on in the same way as in the prior art, whereas, when the combustion chamber temperature is relatively low, compression heating is carried out with the throttle valve closed, and after a predetermined time has elapsed, the fuel injection is started, and when the combustion chamber temperature is particularly low, compression heating is effected with the throttle valve fully opened, and after a predetermined time has elapsed, the throttle valve is closed and, at the same time, the fuel injection is started, thus improving the startability.

Figure 15:
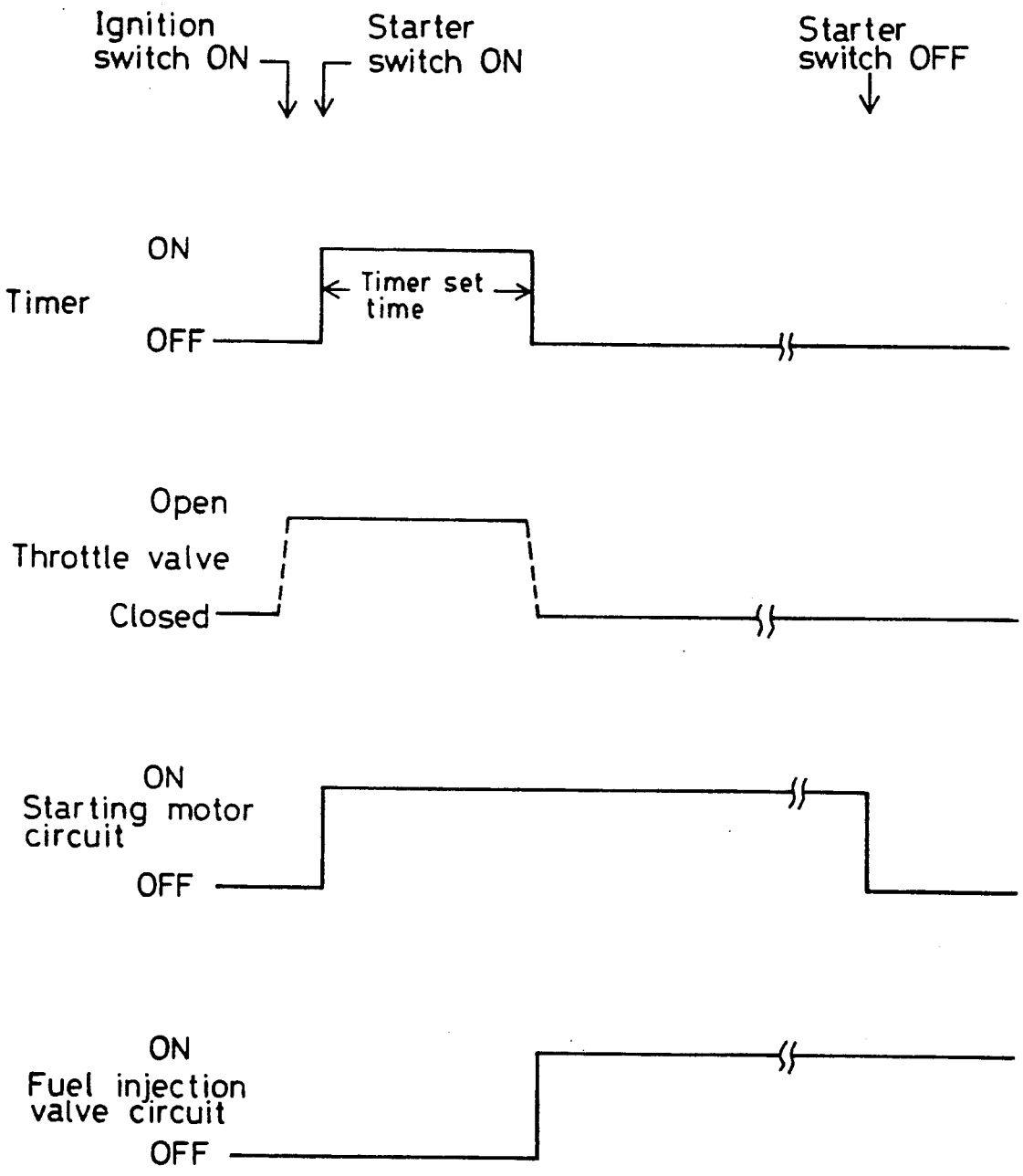
FIG. 15 is a time chart showing the injection start timing.

FIG. 15 is a time chart showing the fuel injection start timing control that is executed at the time of starting the engine in particularly low-temperature conditions.

As shown in the figure, at the same time as the ignition switch is turned on, the throttle valve is fully opened. When the starter switch is turned on, the starting motor circuit is activated to drive the starting motor and, at the same time, the timer is set. The value set on the timer is properly determined in accordance with the flash point of the fuel used. Since in this state the intake air quantity is at the maximum level, the compression pressure is high, so that the temperature in the combustion chamber rises along the chain-line curve shown in FIG. 14. When the set time has been elapsed, the throttle valve is closed, and the minimum quantity of air that is necessary for combustion is sucked in through the bypass passage. At the same time, the fuel injection valve circuit is activated to start the fuel injection. At this time, the combustion chamber temperature lowers a little due to the heat of vaporization of the fuel, but since the combustion chamber has already reached a predetermined temperature, the engine can be readily started. Thereafter, the starting motor is turned off.

To execute the above-described operation, data concerning the injection start timing that is set in accordance with the flash point of the fuel used and the combustion chamber temperature at the time of starting the engine is formed into a map to obtain a control table, and when the engine is to be started, the fuel injection start timing is controlled with reference to the control table, thereby enabling an improvement in the startability.

Figure 16:
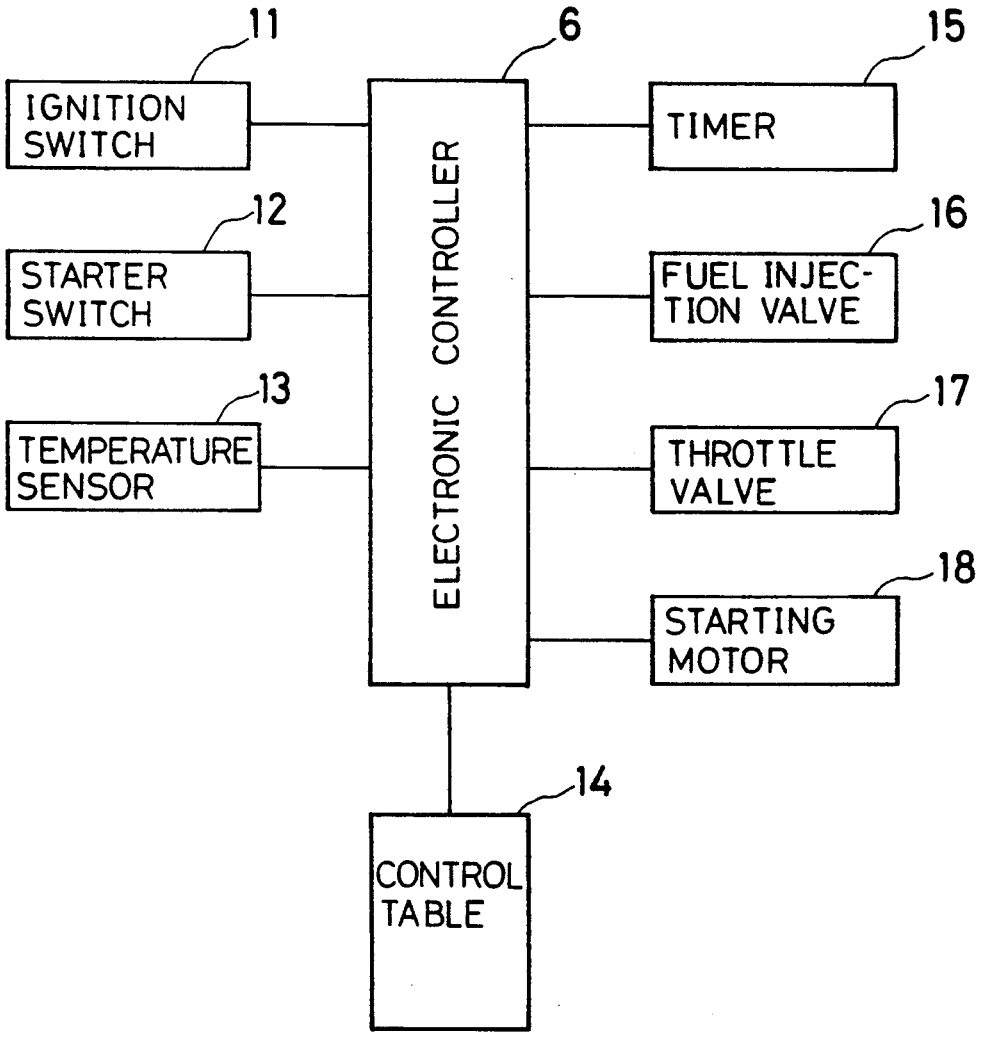
FIG. 16 is a block diagram showing the arrangement of a system for carrying out the injection start timing control method.

FIG. 16 is a block diagram showing the arrangement of a system for effecting the above-described fuel injection start timing control.

An electronic controller 6 reads signals from an ignition switch 11, a starter switch 12 and a temperature sensor 13 to control the drive of a fuel injection valve 16 with reference to a control table 14 formed from data concerning the fuel injection start timing that is set in accordance with the flash point of the fuel used and the combustion chamber temperature. If the combustion chamber temperature is higher than a predetermined level, at the same time as the starter switch is turned on, the fuel injection valve 16 is driven to start the fuel injection. When the combustion chamber temperature is relatively low, the throttle valve 17 is either fully opened or closed in accordance with the level of the temperature, thereby heating the combustion chamber with the compression pressure being varied in accordance with the temperature. When receiving a time-out signal from a timer 15 after a predetermined time has elapsed, the electronic controller 6 drives the fuel injection valve 16 to start the fuel injection. By controlling the fuel injection start timing in this way, the startability can be improved.

It should be noted that the present invention is applicable to both the SPI (Single Point Injector) system in which fuel injection is performed in the vicinity of a carburetor to distribute the fuel to the cylinders and the MPI (Multi Point Injector) system in which fuel injection is performed in the vicinity of the intake valve of each cylinder. Further, this embodiment is also applicable to liquid fuel injection systems such as pressure injection valve system, carburetor system, etc.

According to this embodiment, the fuel injection start timing is varied in accordance with the combustion chamber temperature at the time of starting the engine, and when the combustion chamber temperature is relatively low, the fuel injection is not immediately started but it is done after the combustion chamber has been heated by compression heat for a predetermined period of time. It is therefore possible to improve the cold startability even in the case of a fuel having a relatively high flash point.

Another embodiment of the present invention, which is arranged to control the fuel injection timing, will next be explained with reference to FIGS. 17 to 20.

Figure 17:
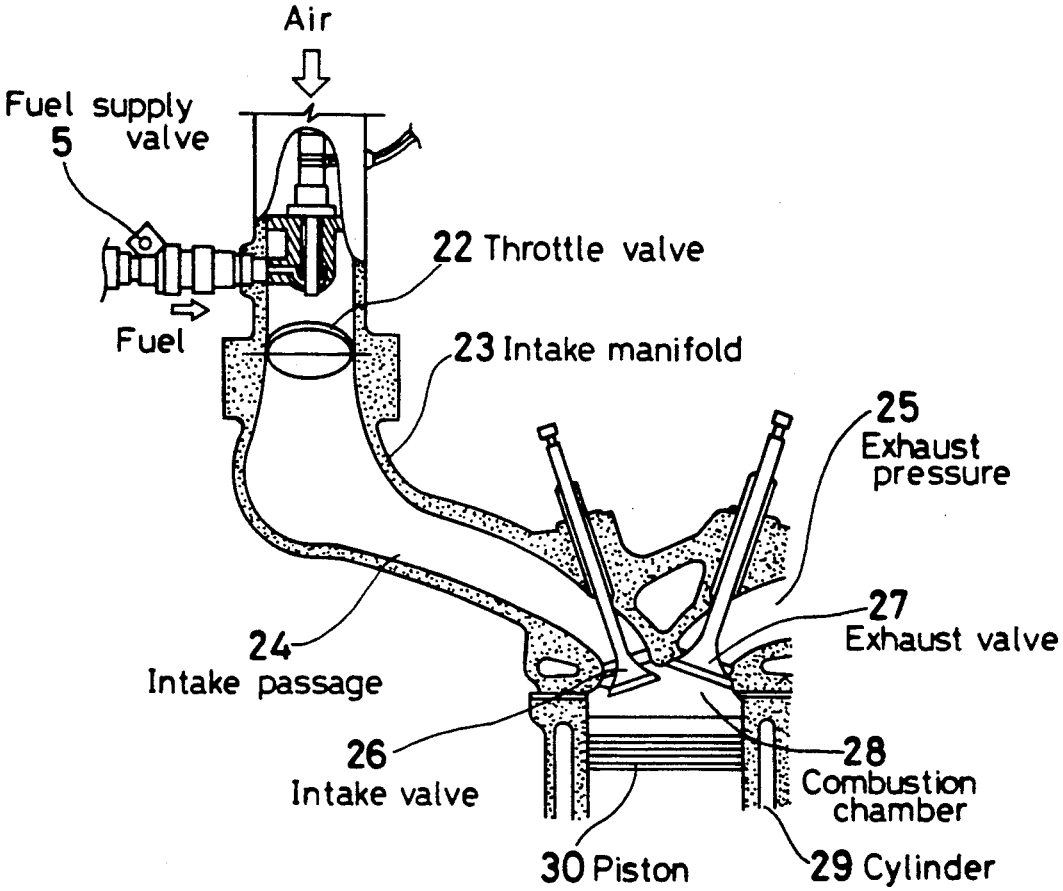
FIG. 17 shows an arrangement which is employed when an ultrasonic atomizer is applied to an SPI engine.

The ultrasonic atomizer is attached to an SPI (Single Point Injector) automotive engine, as exemplarily shown in FIG. 17. It should be noted that in the figure the direction of fuel feed is shown to be perpendicular to the axis of the ultrasonic atomizer and only one cylinder is shown, for sake of convenience.

In the arrangement shown in FIG. 17, fuel that is intermittently fed from a fuel supply valve 5 is atomized by the ultrasonic atomizer and mixed with a stream of air to form a fuel-air mixture, which is then led to a combustion chamber 28 through a throttle valve 22, an intake passage 24 which is defined by an intake manifold 23 and an intake valve 26. The fuel-air mixture delivered into the combustion chamber 28 is burned by spark ignition, and the resulting power is transmitted to a piston 30 in a cylinder 29. The burnt gas is discharged from an exhaust valve 27 through an exhaust passage 25. In such an SPI engine, the fuel injection position and the combustion chamber are distant from each other and there is therefore a delay in delivery of the fuel. The ultrasonic atomizer that is shown in FIG. 5 is also applicable to MPI (Multi Point Injector) engines in which fuel injection is carried out in the vicinity of the intake valve of each cylinder, as a matter of course.

Incidentally, the air velocity in the intake pipe varies all the time in response to the opening and closing operation of the intake valve. When the fuel injection is intermittently carried out by driving the ultrasonic atomizer in the system shown in FIG. 17 in the state where the air velocity varies in this way, as long as the engine is in a steady-state condition, for example, a constant-velocity condition, there is substantially no effect on the engine output even if the fuel injection timing is not particularly controlled. The reason for this is considered that, since the injected fuel takes a given time (delivery delay) to reach the inside of the cylinder 29 through the intake passage 24 and the intake valve 26 and the fuel injection is consecutively performed with a constant injection pressure, the variations in the air velocity are leveled out.

In contrast, when the engine is in a transient condition, for example, acceleration or deceleration, the injection pressure changes and hence the resulting engine output differs depending upon the timing at which the fuel is injected from the ultrasonic atomizer. For example, if the air stream in the vicinity of the injection position flows at a high velocity when the fuel is injected, the fuel is delivered through the intake passage 24 by the high-velocity air stream as soon as it is injected Accordingly, the injected fuel does not sufficiently spread in the intake passage 24 and fails to mix with air thoroughly, resulting in a lowering of the combustion efficiency. It is therefore impossible to maximize the engine output. On the other hand, even when the fuel that is injected from the ultrasonic atomizer sufficiently spreads in the intake passage 24, if there is no adequate air stream therein, the atomized fuel adheres to the wall surface and does not mix with air satisfactorily. Thus, in this case also, the engine output cannot be maximized. This phenomenon is particularly noticeable in the SPI system, but it also occurs in the MPI system.

As will be understood from the above, under the condition that the air velocity varies in response to the opening and closing operation of the intake valve, the fuel injection timing in the ultrasonic atomizer should not be too early or too late relative to the timing at which the air velocity rises. After exhaustive studies, we have found that the optimal fuel injection timing for the ultrasonic atomizer is immediately before the air stream in the vicinity of the ultrasonic atomizer reaches a high-velocity state.

Figure 18:
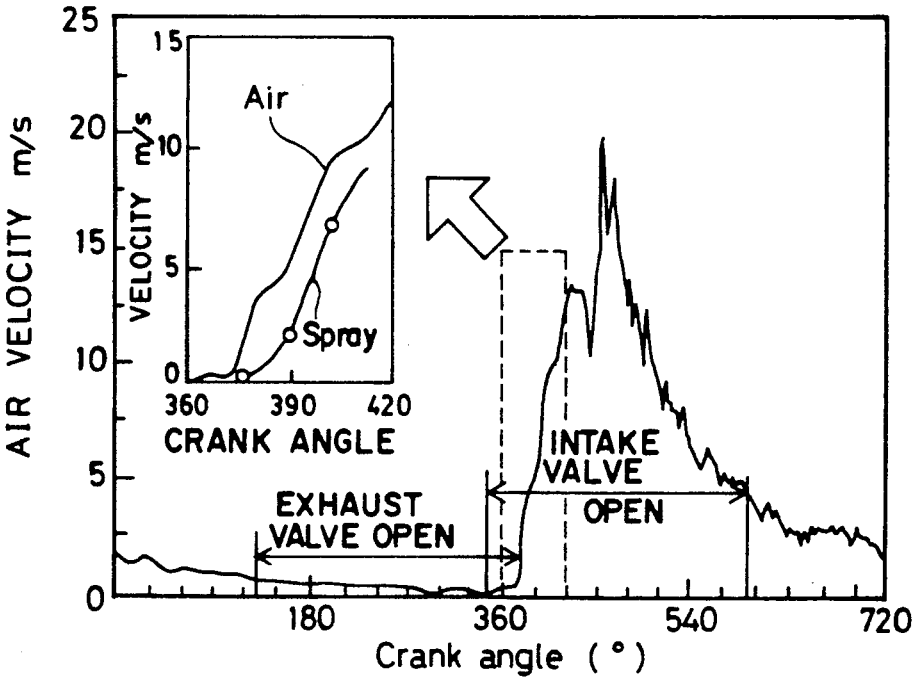
FIG. 18 shows an ultrasonic atomizer drive control method.

FIG. 18 is a graph showing the relationship between the air velocity and the injected fuel velocity when the fuel injection is executed at a crank angle of 360°, in which the abscissa axis represents the crank angle, and the ordinate axis the air velocity.

In this example, the fuel is injected from the ultrasonic atomizer immediately before the air velocity rises in response to the opening of the intake valve. As will be clear from the enlarged view of the chain-line portion of the graph. Since the air velocity is first substantially zero, the atomized fuel spreads all over the cross-sectional area of the intake pipe. The atomized fuel is then carried by an air stream the velocity of which rises immediately after the fuel injection. Thus, the velocity of the injected fuel increases with the same tendency as that of the air velocity. In the experiment, it was observed that the fuel atomized and spread all over the cross-sectional area of the intake pipe was delivered to the combustion chamber in this state, and it was possible to maximize the engine output.

Figure 19:
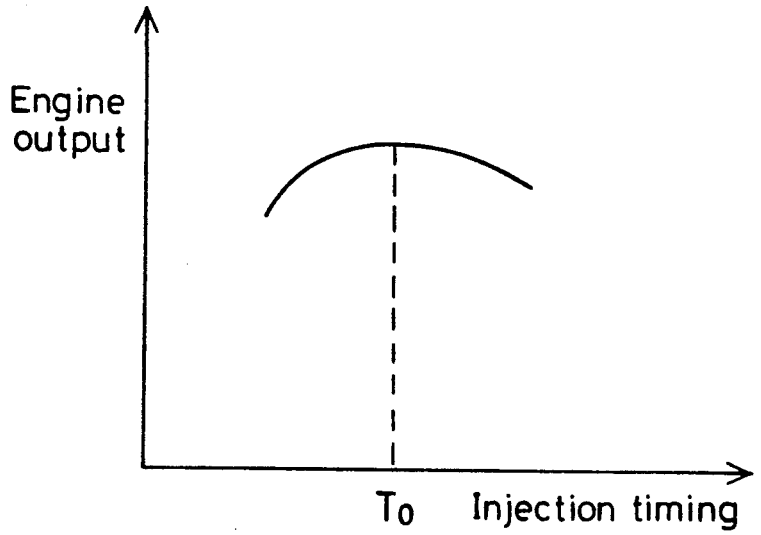
FIG. 19 shows the relationship between the injection timing and the engine output.

Thus, when the engine is in a transient condition, an optimal injection timing $T_O$ is present in the relationship between the fuel injection timing of the ultrasonic atomizer and the engine output, as shown in FIG. 19. The optimal injection timing depends on the distance between the ultrasonic atomizer and the combustion chamber, engine speed, temperature, etc., but it is immediately before the air stream in the vicinity of the ultrasonic atomizer reaches a high-velocity state, as stated above.

Accordingly, each particular engine is actually driven with parameters, e.g., the engine speed, temperature, etc., being variously changed to detect an optimal injection timing, i.e., a temporal position that is immediately before the velocity of an air stream in the vicinity of the ultrasonic atomizer rises. The optimal injection timing data for various engine conditions are formed into a map to obtain a control table, and when the engine is in a transient condition, the fuel injection is controlled with reference to the control table. Thus, it is possible to achieve efficient drive of the engine.

Figure 20:
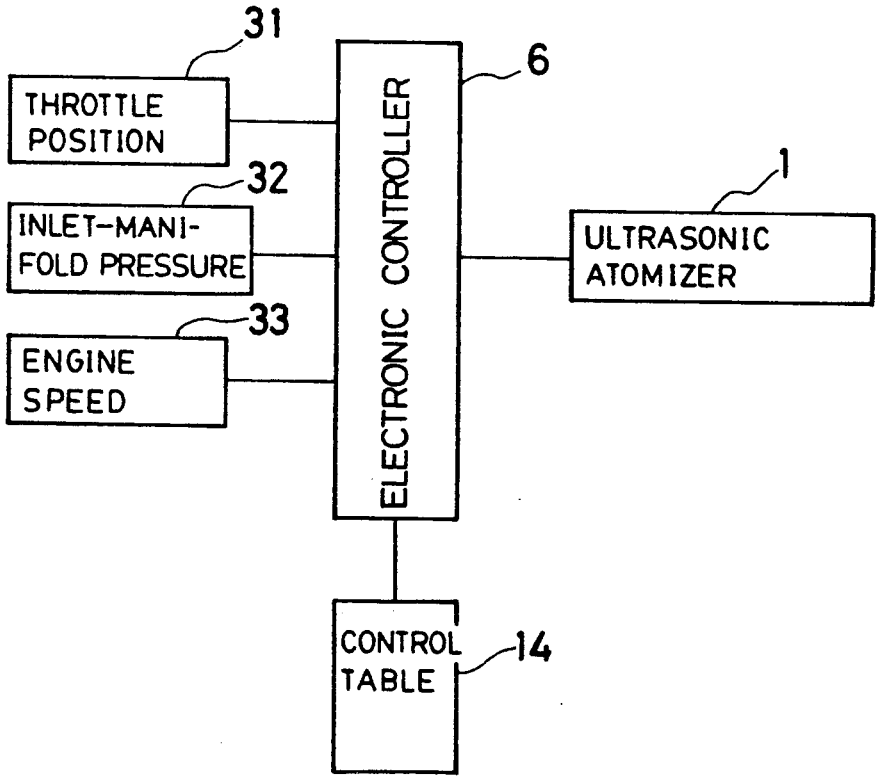
FIG. 20 is a block diagram showing an arrangement for carrying out the ultrasonic atomizer drive control method according to the present invention.
Figure 21A:
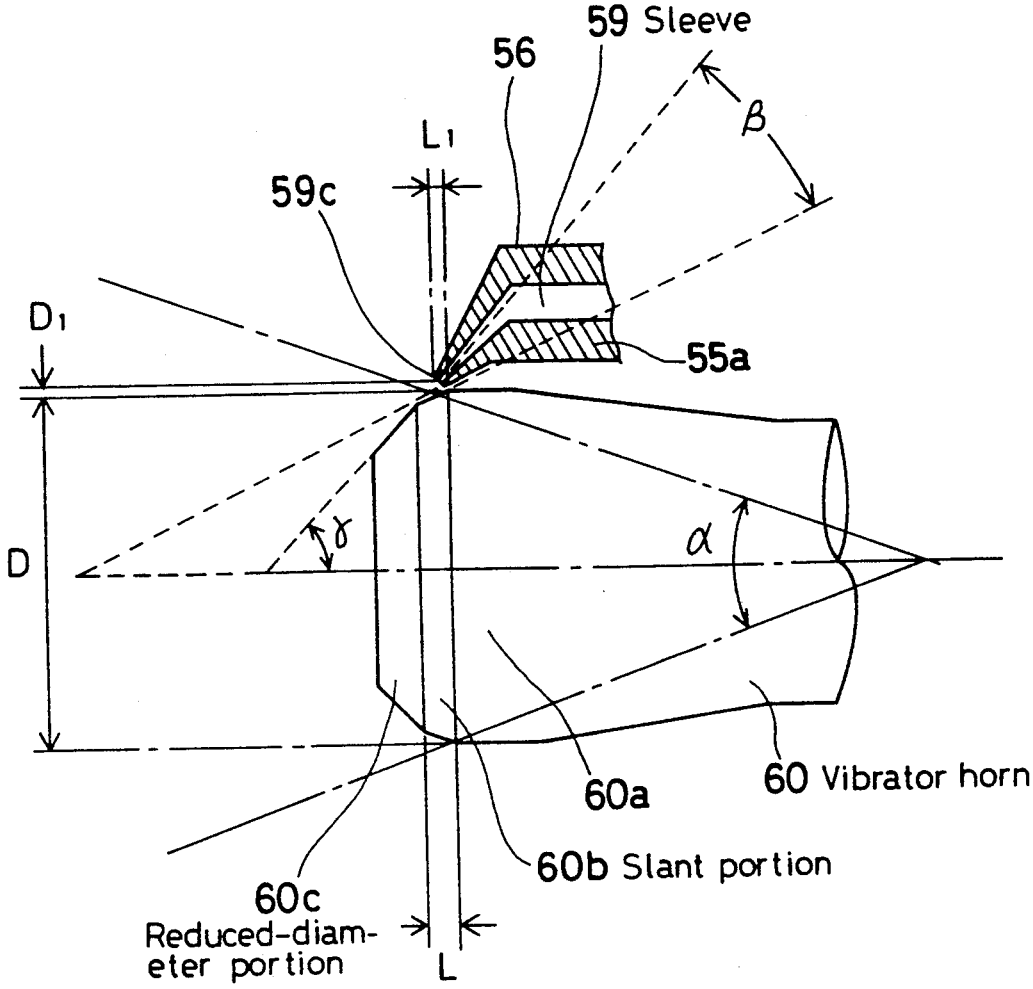
FIGS. 21(*a*)–21(*e*) are fragmentary sectional views of one embodiment of the ultrasonic atomizer.
Figure 21B:
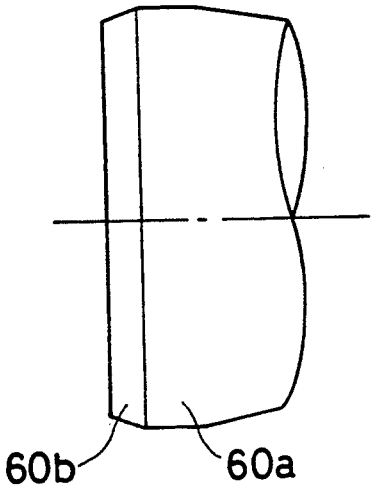
Figure 21C:
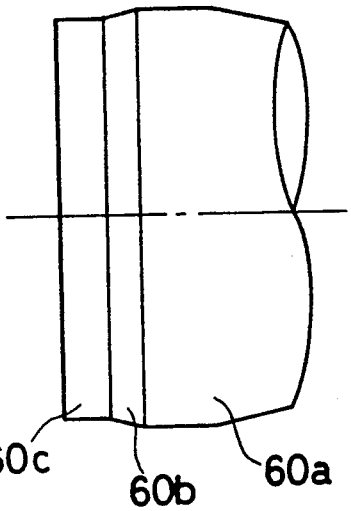
Figure 21D:
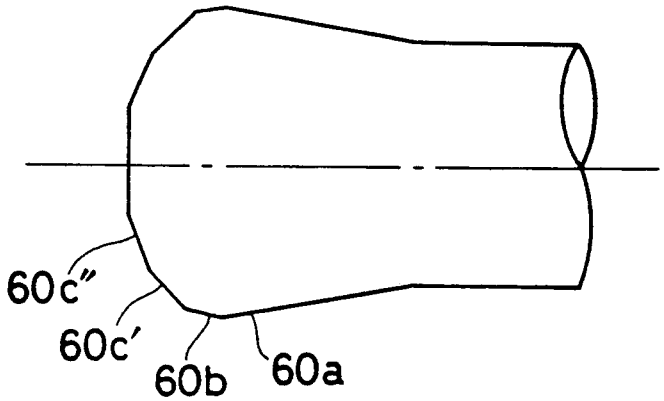
Figure 21E:
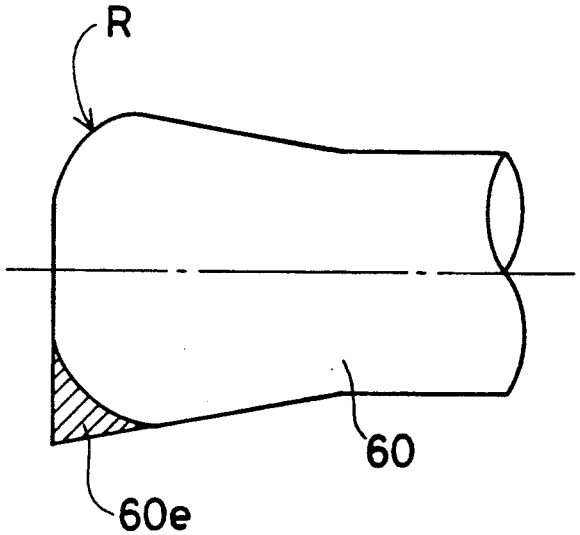

FIG. 20 shows a specific arrangement for carrying out the above-described fuel supply control method. Signals which are output from a throttle position sensor 31, an inlet-manifold pressure sensor 32, an engine speed sensor 33, etc. are read in an electronic controller 6, and when the engine is in a transient condition, the ultrasonic atomizer 1 is driven with reference to a control table 14 formed from optimal injection timing data, thereby enabling efficient drive of the engine.

According to this embodiment, when the engine is in a transient condition such as starting, acceleration or deceleration, the fuel injection is executed immediately before the velocity of an air stream in the vicinity of the ultrasonic atomizer rises, thereby enabling the fuel that is atomized with a sufficiently wide spread from the ultrasonic atomizer to be carried in this state to the combustion chamber by the air stream. It is therefore possible to obtain a maximal output.

One embodiment of an ultrasonic atomizer which is suitable for the fuel supply control method according to the present invention will next be explained with reference to FIGS. 21 to 24.

Figure 22:
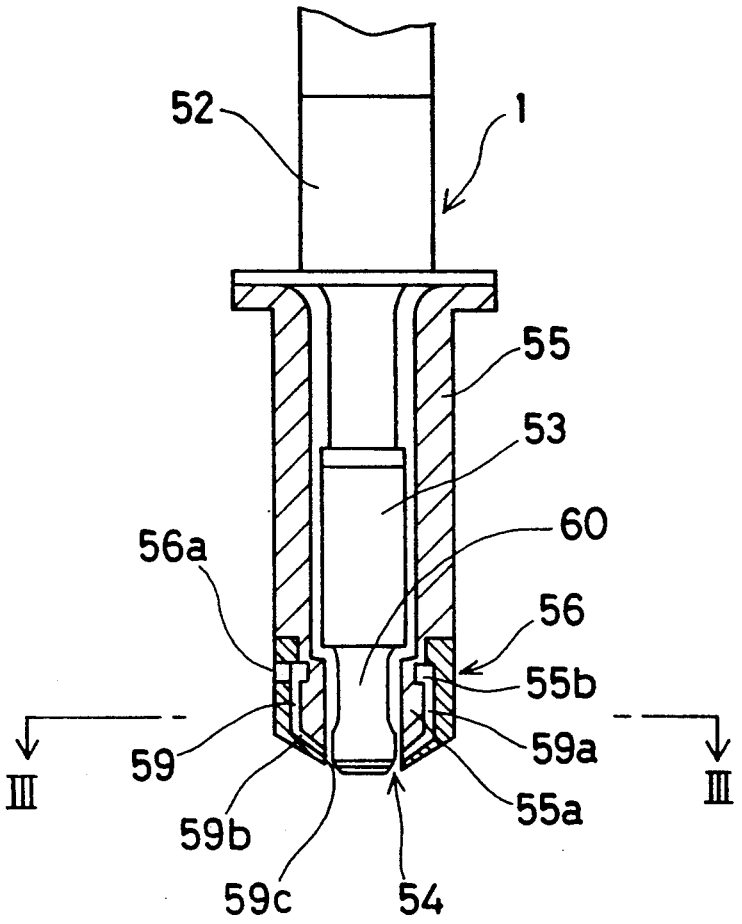
FIG. 22 is a general sectional view of one embodiment of the ultrasonic atomizer.
Figure 23:
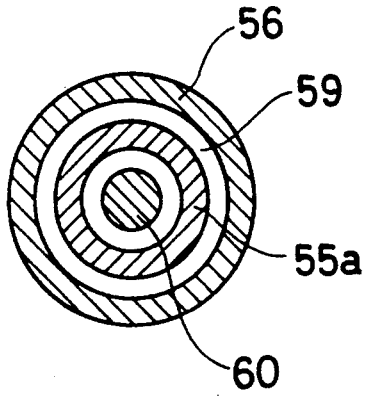
FIG. 23 is a sectional view taken along the line III—III of FIG. 22.
Figure 24:
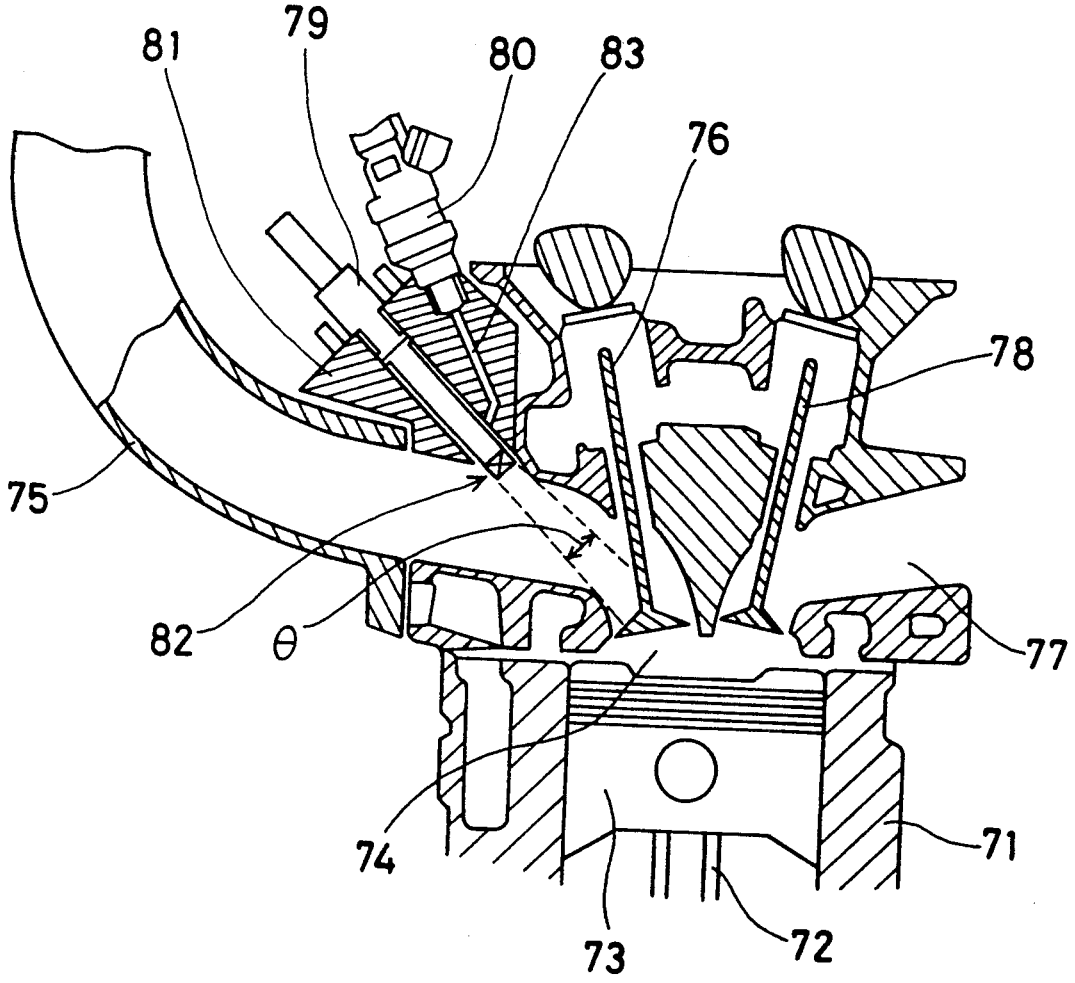
FIG. 24 is a sectional view of an alcohol engine to which the present invention is applied.

FIG. 21 is a fragmentary sectional view showing one embodiment of the ultrasonic atomizer; FIG. 22 is a general sectional view showing one embodiment of the ultrasonic atomizer; FIG. 23 is a sectional view taken along the line III—III of FIG. 22; and FIG. 24 is a sectional view of an alcohol engine that uses an ultrasonic atomizer. Referring to FIG. 24, reference numeral 71 denotes a cylinder, 72 a connecting rod, 73 a piston, 74 a combustion chamber, 75 an intake pipe, 76 an intake valve, 77 an exhaust pipe, and 78 an exhaust valve. A mount 81 which is firmly fitted with an ultrasonic atomizer 79 and a fuel injection valve 80 is disposed at a predetermined position on the intake pipe 75. A vibrator 82 is provided on the distal end of the ultrasonic atomizer 79 in opposing relation to the intake valve 76. An alcohol fuel is fed to the vibrator 82 from the fuel injection valve 80 through a fuel feed passage 83. The fuel is atomized by the vibrator 82 and sprayed into the intake pipe 75.

Referring to FIGS. 22 and 23, an ultrasonic atomizer 1 has an ultrasonic vibration generating part 52 at the proximal end thereof. The ultrasonic vibration generating part 52 is connected with a vibrator shaft portion 53 and a vibrator horn 60, and an atomization surface 54 is formed on the distal end portion of the horn 60.

The outer periphery of the vibrator shaft portion 53 is surrounded by a substantially annular sleeve member 55. An annular casing member 56 is secured to the outer periphery of the distal end portion **55*a* of the sleeve member 55, the casing member 56 having a slightly larger inner diameter than the outer diameter of the distal end portion 55*a*, thus defining a sleeve 59 between the distal end portion 55*a* of the sleeve member 55 and the casing member 56. In addition, the distal end portions of the sleeve member 55 and the casing member 56 are tapered, so that an annular passage 59*a*, slant passage 59*b* and opening 59*c* are formed between the outer peripheral surface of the distal end portion 55*a* of the sleeve member 55 and the inner peripheral surface of the casing member 56. It should be noted that the sleeve member 55 has a circumferential groove 55***b* which is provided at a suitable position on the outer peripheral surface thereof over the entire circumference, and the casing member 56 is provided with a fuel feed opening 56*a* at a suitable position thereof, the fuel feed opening 56*a* being communicated with both the circumferential groove 55*b* and the passage 59*a*.

The fuel feed opening 56*a* in the casing member 56 is fed with an alcohol fuel from the fuel injection valve, so that the fuel is supplied all over the circumferential groove 55*b* in the sleeve member 55. The fuel supplied into the circumferential groove 55*b* passes through the passage 59*a*, the slant passage 59*b* and the opening 59*c* to reach the atomization surface 54, where the fuel is atomized by ultrasonic vibrations that are transmitted from the ultrasonic vibration generating part 52.

FIG. 21 is a sectional view showing the configurations of the distal ends of the sleeve 59 and the vibrator horn 60 in the above-described ultrasonic atomizer 1. The vibrator horn 60 has an enlarged-diameter portion 60*a*, a slant portion 60*b* and a reduced-diameter portion 60*c* at the distal end thereof. The enlarged-diameter portion 60*a* serves to enlarge the area for atomization. One of the features of this embodiment resides in the provision of the enlarged-diameter portion 60*a* on the vibrator horn 60, but the enlarged-diameter portion 60*a* is provided for the purpose of ensuring the effect to increase the flow rate of the injected liquid; therefore, if it is unnecessary to ensure a particularly high flow rate of the injected liquid, the distal end portion of the vibrator horn 60 does not necessarily need to be enlarged in diameter but may have a uniform diameter.

One example of the dimension of each portion will be shown below. It is assumed that the diameter of the enlarged-diameter portion 60*a* of the vibrator horn 60 is D=9 mm, and the axial length of the slant portion 60*b* is L=0.5 mm. L/D is within the range of from 1/10 to 1/30, preferably about 1/18.

(1) The spray angle $\alpha$ is set within the range of from 30° to 45°. The reason for this is that, although it is important to set an angle of spray so that no fuel adheres to the inner wall of the intake pipe when the ultrasonic atomizer is mounted on an engine, it is also necessary in order to achieve effective mixing of the fuel with air to widen the spray angle to a certain extent.

(2) The angle $\beta$ between the distal end of the sleeve 9 and the slant portion 60*b* is set within the range of from 5° to 45°, preferably about 15°, with a view to enabling the injected fuel to lane on the atomization surface with ease without being scattered.

(3) The angle $\gamma$ of the reduced-diameter portion 60*c* with respect to the axial center is set within the range of from 0° to 90°, preferably from 40° to 50°. FIG. 21(*b*) shows an example in which $\gamma=90°$, and FIG. 21(*c*) shows an example in which $\gamma=0°$. The smaller the angle $\gamma$, the wider the spray angle $\alpha$, and vice versa.

(4) The distance D1 between the opening 59*c* of the sleeve 59 and the enlarged-diameter portion 60*a* of the vibrator horn 60 is set within the range of from 0.05 mm to 0.5 mm, preferably from 0.1 mm to 0.2 mm, (i.e., D1/D=0.01 to 0.02). The reason for this is that, if the distance D1 is less than the lower limit, the clearance between the distal end of the sleeve 59 and the vibrator horn 60 is too narrow and there is therefore a problem if these members coming into contact with each other, whereas, if the distance D1 exceeds the upper limit, when the flow rate or pressure of the liquid is low, the liquid cannot reach the surface of the slant portion 60*b* but may drop undesirably.

(5) The distance L1 between the opening 59*c* of the sleeve 59 and the enlarged-diameter portion 59*a* is set within the range of from 0 to 0.5 mm (i.e., L1/L=0 to 1). If the distance L1 is reduced to bring the opening 59*c* closer to the enlarged-diameter portion 60*a*, it becomes difficult to form a liquid film, whereas, if the distance L1 is increased to bring the opening 59*c* closer to the reduced-diameter portion 60*c*, the angle of incidence becomes a minus angle, so that the injected liquid cannot land on the surface of the slant portion 60*b*.

FIG. 21(*d*) shows another example in which the reduced-diameter portion 60 comprises two reduced-diameter portions 60*c*′ and 60*c*″. FIG. 21(*e*) shows still another example in which the distal end portion 60*e* of the vibrator horn 60 is cut so that the slant portion and the reduced-diameter portion are continuous with each other with a curvature R.

The function of the ultrasonic atomizer having the above-described arrangement will be explained below.

The alcohol fuel passes through the circumferential groove 55*b*, the passage 59*a*, the slant passage 59*b* and the opening 59*c* to reach the atomization surface 54. Since the fuel is supplied to the entire circumferences of the opening 59*c* and the slant portion 60*b* through the entire circumference of the circumferential groove 55*b*, the fuel is formed into a liquid film with a substantially uniform thickness during this process and reaches the slant portion 60*b* in this state. The fuel reaching the slant portion 60*b* is atomized by ultrasonic vibrations transmitted from the ultrasonic vibration generating part 52, and the fuel that is left unatomized flows smoothly to the reduced-diameter portion 60*c*, where it is all atomized. Thus, the fuel is sprayed with the spray angle $\alpha$.

According to this embodiment, it is possible to obtain an optimal spray angle irrespective of the flow rate of the fed alcohol fuel by improving the configuration of the distal end of the vibrator in the ultrasonic atomizer. In addition, it is possible to increase the turn-down ratio and obtain a spray which is uniform over the entire circumference and hence improve the startability of alcohol engines. It is also possible to supply fuel into a cylinder without the adhesion of the fuel to the inner wall of the intake pipe.

Further, it is possible to increase the spray flow rate and enable an engine operation using an ultrasonic atomizer even when the engine is in a normal operating condition, and since the carburetor can be omitted, the mechanism is simplified.

What we claim is:

1. In a method of driving an engine wherein a fuel is atomized by an ultrasonic atomizer and carried by a stream of air to a combustion chamber where atomized fuel is ignited by a spark, a fuel supply control method comprising the steps of:

controlling a fuel supply pattern at least at a time of starting the engine, wherein the fuel is continuously injected where the engine is started in low-temperature conditions, and when said continuous fuel injection is performed, fuel feed pressure is lowered.

2. A fuel supply control method of driving an engine wherein a fuel is atomized by an ultrasonic atomizer and carried by a stream of air to a combustion chamber where atomized fuel is ignited by a spark, a fuel supply control method comprising the steps of:

controlling a fuel supply pattern at least at a time of starting the engine;

varying fuel injection start timing according to whether a combustion chamber temperature is higher or lower than a predetermined temperature at the time of starting the engine, wherein, when the combustion chamber temperature is lower than a predetermined temperature, a starter switch is turned on with a throttle valve closed, and fuel injection is started after a predetermined time has elapsed.

3. A fuel supply control method of driving an engine wherein a fuel is atomized by an ultrasonic atomizer and carried by a stream of air to a combustion chamber where atomized fuel is ignited by a spark, said fuel supply control method comprising the steps of:

controlling a fuel supply pattern at least at the time of starting the engine;

varying fuel injection start timing according to whether a combustion chamber temperature is higher or lower than a predetermined temperature at the time of starting the engine, wherein, when the combustion chamber temperature is lower than a predetermined temperature, a throttle valve is opened when an ignition switch is turned on, and after a predetermined time has elapsed, said throttle valve is closed, and at the same time, fuel injection is started.

* * * * *

UNITED STATES PATENT AND TRADEMARK OFFICE

CERTIFICATE OF CORRECTION

PATENT NO. : 5,179,923

DATED : January 19, 1993

INVENTOR(S) : TSURUTANI et al

It is certified that error appears in the above-identified patent and that said Letters Patent is hereby corrected as shown below:

On the title page, at Item number [75], change the name of the city for all of the inventors from "Ooi" to --SAITAMA--.

Signed and Sealed this

Twenty-third Day of November, 1993

*Attest:*

Bruce Lehman

BRUCE LEHMAN

*Attesting Officer*

*Commissioner of Patents and Trademarks*